US007383595B1

(12) United States Patent
Czupil

(10) Patent No.: US 7,383,595 B1
(45) Date of Patent: Jun. 10, 2008

(54) HOLDER FOR A RAZOR DISPENSER CARTRIDGE

(76) Inventor: Jason Czupil, 425 Shadow Grass Ave., Fort Worth, TX (US) 76120

( * ) Notice: Subject to any disclaimer, the term of this patent is extended or adjusted under 35 U.S.C. 154(b) by 254 days.

(21) Appl. No.: 11/305,687

(22) Filed: Dec. 16, 2005

(51) Int. Cl.
*A47K 3/30* (2006.01)
*B65D 85/00* (2006.01)
*A47F 5/08* (2006.01)

(52) U.S. Cl. ..... 4/605; 206/228; 206/372; 206/373; 211/113; 221/283

(58) Field of Classification Search ..... 206/351–355, 206/806, 228, 349, 372, 337; 4/605; 239/282–283; 211/113–119, 70.6; D6/524–527; 221/281, 221/283
See application file for complete search history.

(56) References Cited

U.S. PATENT DOCUMENTS 4,140,244 A * 2/1979 Clabby ..... 211/281
4,218,013 A * 8/1980 Davison ..... 239/74
4,398,309 A * 8/1983 Simons ..... 4/605
4,450,980 A * 5/1984 Clabby et al. ..... 221/281
4,573,591 A * 3/1986 Chap ..... 211/113
4,998,647 A * 3/1991 Sharp ..... 211/113
5,131,564 A * 7/1992 Plonkey ..... 206/355
5,255,401 A * 10/1993 Sambrookes et al. ..... 4/605
5,620,105 A * 4/1997 Macek ..... 211/119
5,730,302 A * 3/1998 Groene ..... 211/70.6
6,276,529 B1 * 8/2001 Feehan, Jr. ..... 206/352
6,415,517 B1 * 7/2002 Worrick, III ..... 206/228
6,557,265 B2 5/2003 Coffin
6,598,609 B2 7/2003 Gibbs
6,796,455 B2 9/2004 Schmidt
6,820,821 B2 * 11/2004 Linstedt et al. ..... 239/222.11
6,869,053 B2 3/2005 Adams
7,159,324 B2 * 1/2007 Worrick, III ..... 206/228

* cited by examiner

*Primary Examiner*—Bryon P Gehman
(74) *Attorney, Agent, or Firm*—Lars D. Jensen

(57) ABSTRACT

A holder for a razor dispenser cartridge for use in a shower, having an adjustable hook for hanging on a shower head and suction cups for adhering to a wall. Alternate embodiments combine provisions for holding a single razor, a can of shaving cream, and a drawer for temporarily storing used razors.

16 Claims, 10 Drawing Sheets

HOLDER FOR A RAZOR DISPENSER CARTRIDGE

BACKGROUND

This invention relates to a convenient wall-mounted holder for shaving razors, specifically for holding a dispenser of multiple razors. These razors can be of the type having replaceable blades, but more typically entire razors are sold, each of which is disposable.

At present, a package of multiple razors is sold in a plastic bag. A user must remove one razor at a time and remove a protective blade guard. Since the razor can be used more than one time before becoming dull, the current razor is placed haphazardly around the sink or ledge in a shower. Since the package of new razors is usually at some distant location from the sink or shower, it becomes problematic how to obtain a new razor, how to deal with the current razor, and what to do with a depleted razor.

Prior art shown in U.S. Pat. No. 6,598,609 to Gibbs discloses a housing for combining a can of shaving cream with a shaver and replacement shaver heads, but this housing must be placed on a shelf. Prior art shown in U.S. Pat. No. 6,796,455 to Schmidt discloses a wall-mounted blade dispenser whose blades are not of the type used for shaving. Prior art shown in U.S. Pat. No. 6,869,053 to Adams discloses a suction cup with a ring which could be used for hanging a razor.

SUMMARY

In accordance with the present invention, a holder for a razor dispenser cartridge, which hangs from a shower head against a shower wall, comprises: a base having a recess for receiving the razor dispenser cartridge, a hook attached at the top of the base for hanging the holder on the shower head, and one or more suction cups attached to the base for securing the holder to the shower wall. Furthermore the unique construction of the holder and combination of useful features affords ultimate utility for shaving.

One objective of the present invention is to make a new razor immediately accessible. This is accomplished by housing multiple razors in a dispenser cartridge and holding the cartridge near the shower head by providing a base with a hook at the top for hanging on the shower head. Furthermore, this is uniquely accomplished by providing an adjustable attachment means for vertical adjustment of the hook.

Another objective of the present invention is to make a can of shaving cream immediately accessible. This is accomplished by providing a base having a rim for holding the can.

Another objective of the present invention is to provide an immediately accessible place for holding a single razor, so that it can be reused at another time. This is accomplished by providing a base having a pocket for hanging the single razor.

Another objective of the present invention is to provide a place to temporarily store depleted razors, until such time as they can be disposed. This is accomplished by providing a base having a shelf on which a drawer is fitted.

These and other features, aspects, and advantages of the present invention will become better understood with regard to the following description, appended claims, and accompanying drawings.

BRIEF DESCRIPTION OF THE DRAWINGS

The following drawings describe the present invention.

DETAILED DESCRIPTION OF THE INVENTION

Figure 1:
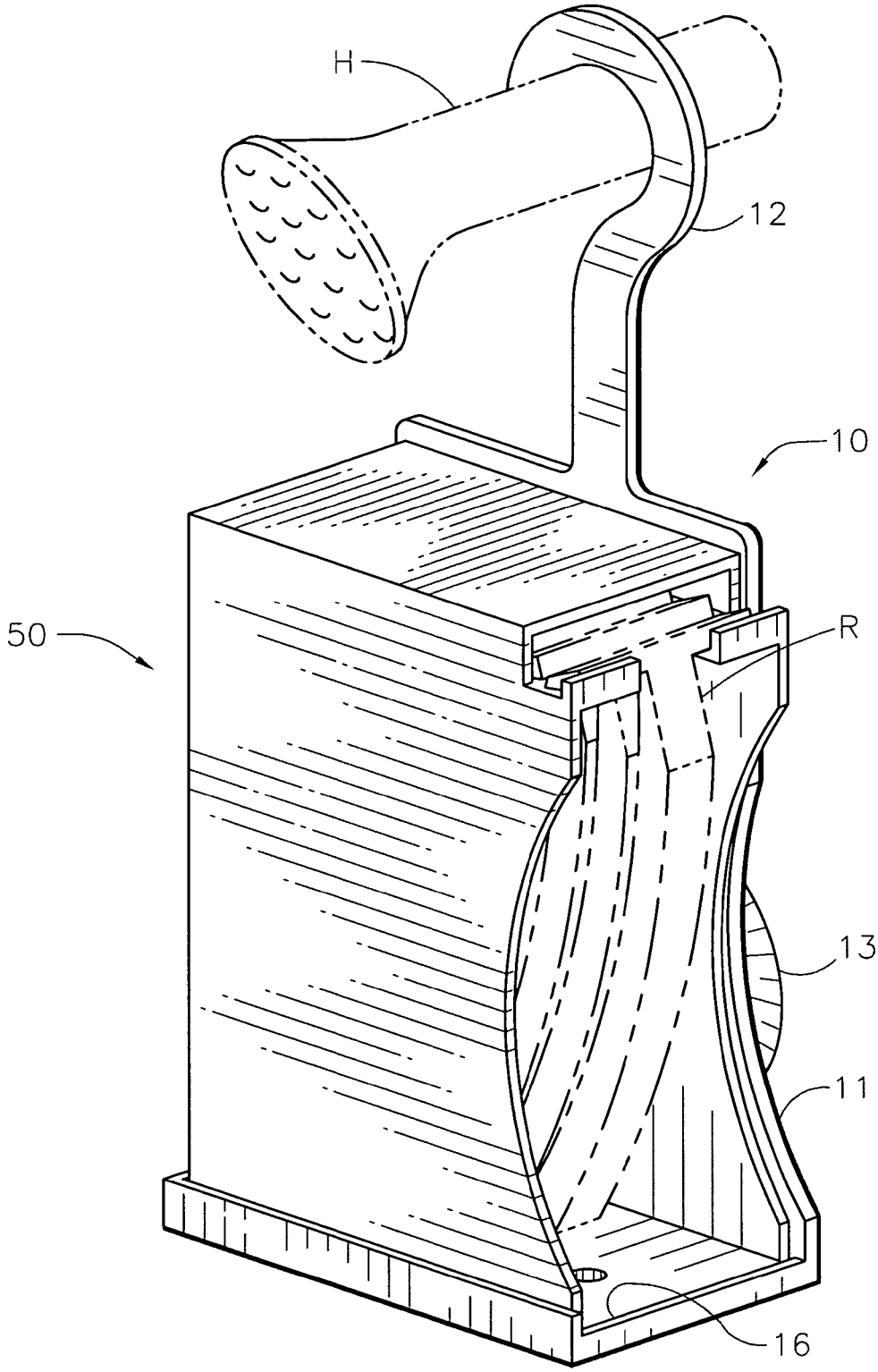
FIG. 1 is a perspective front view of one embodiment of the present invention.

One embodiment of the present invention is shown in FIG. 1 comprising a holder 10 having a base 11 with a recess 16 for receiving a razor dispenser cartridge 50. The top of the holder has a hook 12 for hanging the holder on a shower head H. The razor dispenser cartridge contains one or more razors R for easy and convenient access by the user.

Figure 2:
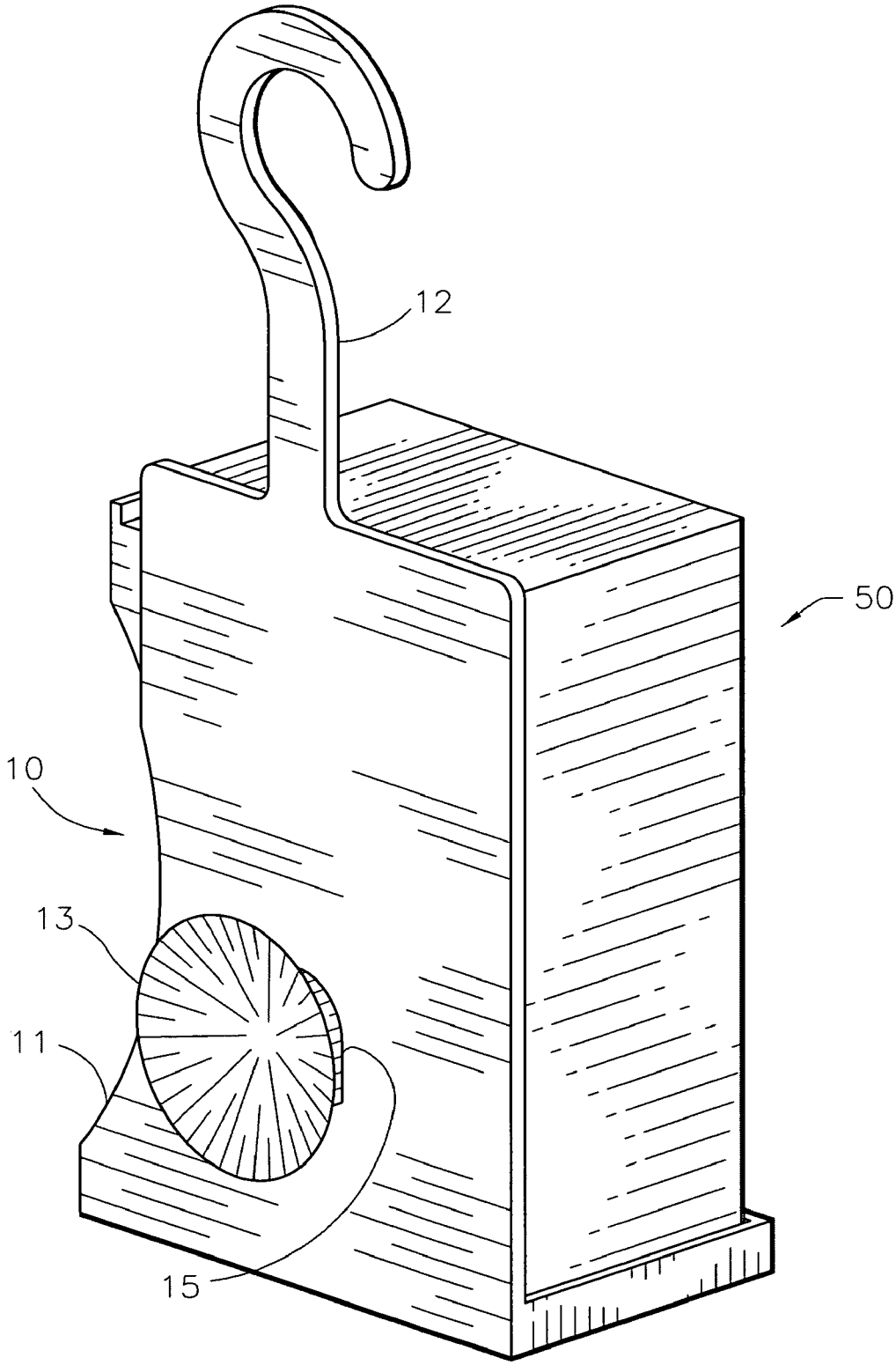
FIG. 2 is a perspective rear view of the embodiment of FIG. 1.

FIG. 2 shows the rear side of holder 10 having a yoke 15 for attaching a flexible suction cup 13. The suction cup is for securing the holder to a nearby wall (not shown) for stability.

Figure 3A:
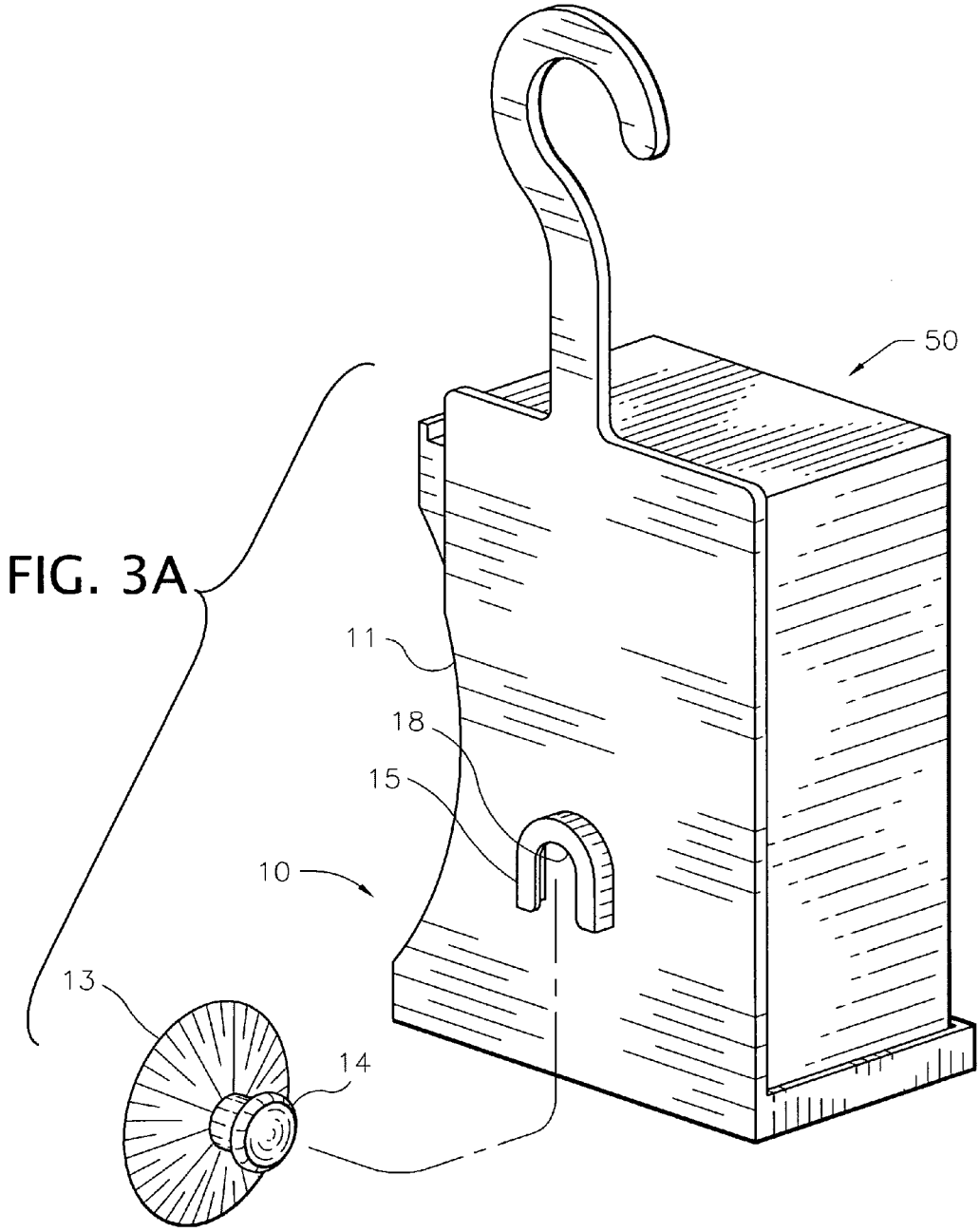
FIG. 3A is an exploded rear view of the embodiment of FIG. 1 showing how a suction cup is attached to a yoke.

FIG. 3A shows the same embodiment of FIG. 2 where the yoke can be seen having an arcuate lip 18. The suction cup 13 has a knob 14 which, by engaging with the arcuate lip, attaches the suction cup to the base 10. This means of attachment is economically suited to join the flexible suction cup material to the rigid base material. However, there are other means of attaching which the inventor envisions, such as fasteners, thermal bonding, and the like which would work equally well in this embodiment.

Figure 3B:
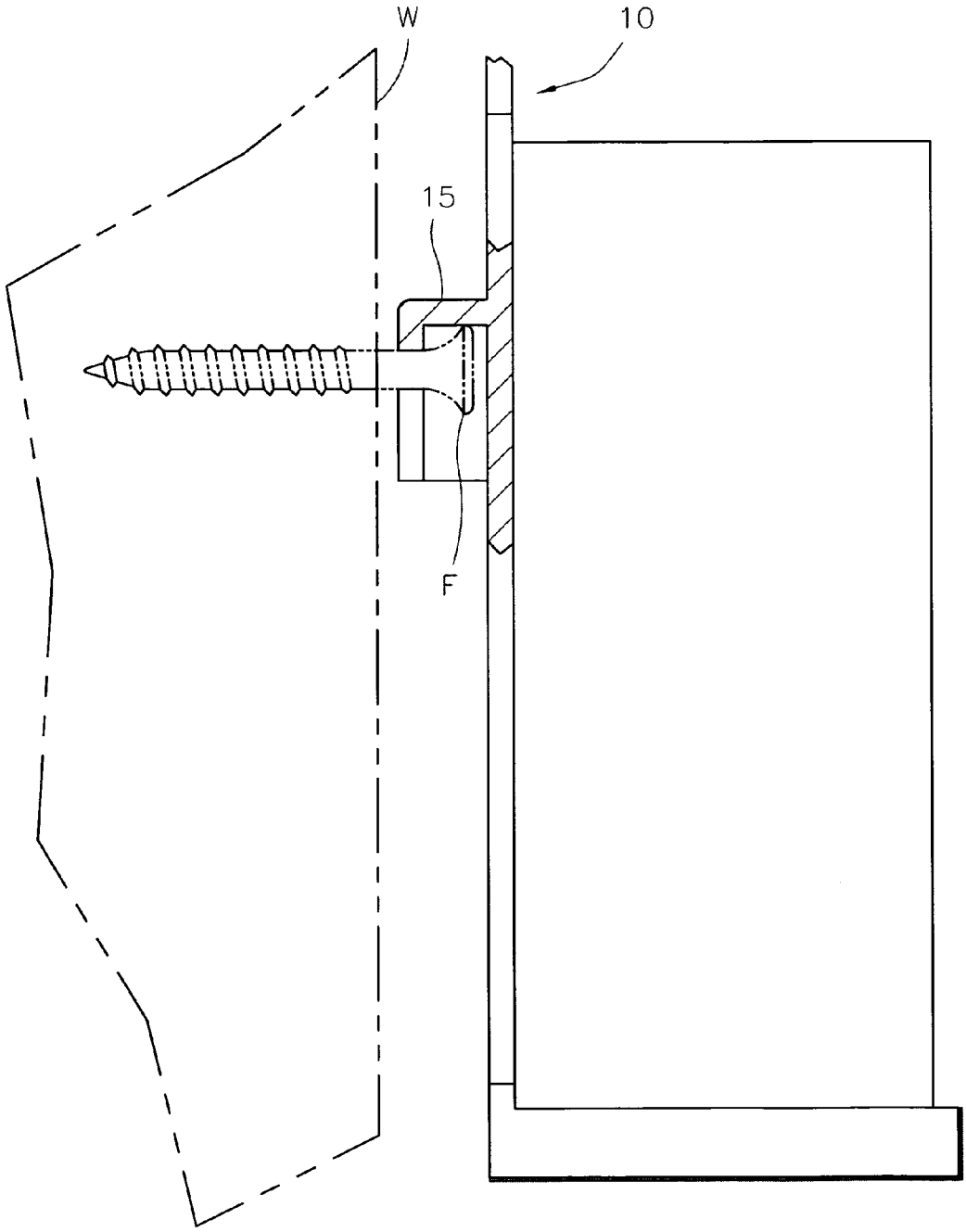
FIG. 3B is a partial cross-sectional side view showing an alternate method of mounting the holder by hanging the yoke on a fastener in a wall.

While the suction cup 13 of the embodiment shown in FIG. 2 has the purpose of securing the holder 10 to the nearby wall, an alternate means of securing the holder to a wall is shown in FIG. 3B where the yoke 15 is shown hooked over the head of a fastener F which has been screwed into a wall W.

Figure 4:
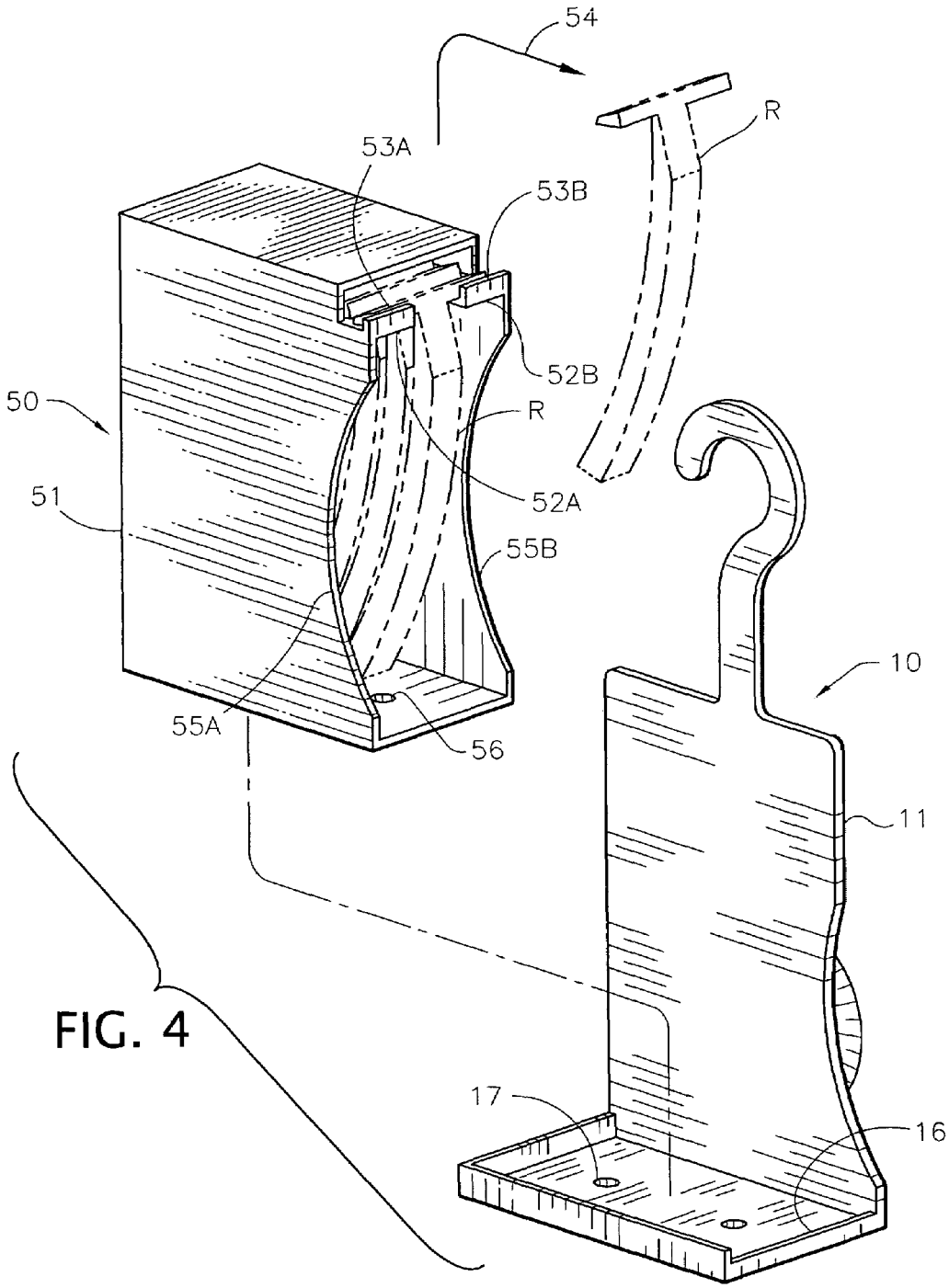
FIG. 4 is an exploded front view of the embodiment of FIG. 1 showing the fitting of a razor dispenser cartridge.

Referring again to the embodiment of the present invention shown in FIGS. 1 and 2, now in FIG. 4 it can be seen how the razor dispenser cartridge 50 fits into the recess 16. There are one or more drain holes 56 in the bottom of the razor dispenser cartridge to prevent shower water from accumulating. Similarly, there are one or more drain holes 17 in the recess.

FIG. 4 also shows a construction of the razor dispenser cartridge 50 having a housing 51 for containing one or more razors R having handles between a left edge 55A and a right edge 55B. The heads of the razors are supported on a left rail 52A and a right rail 52B wherein the rails are horizontal, parallel to one another, and spaced a distance apart for fitting the razor handles there between The outermost razor cannot fall out because it is restrained by a left stop 53A and a right stop 54B. It is preferred that the left edge and the right edge each have a concave shape for allowing the user easy access to grasp the handle of the outermost razor. Thus, the user may remove a razor by lifting and removing according to the arrow denoted by reference numeral 54.

Figure 5A:
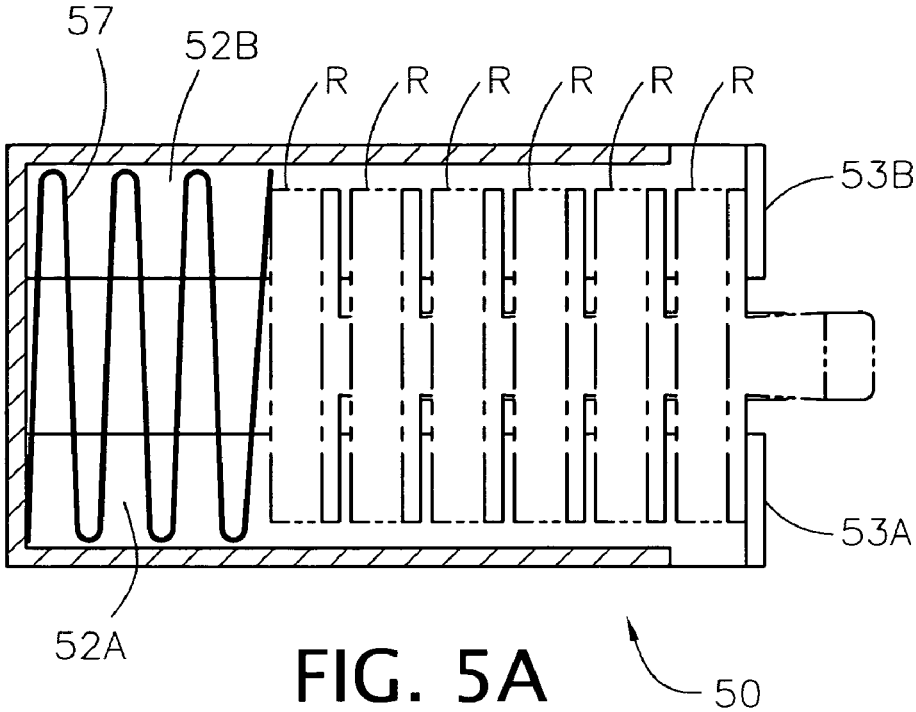
FIG. 5A is a top cross-sectional view of the razor dispenser cartridge containing multiple razors.

FIG. 5A shows a top cross-sectional view of the razor dispenser cartridge 50 where the left rail 52A and right rail 52B can be seen more clearly supporting all razors R. FIG. 5A also reveals a spring 57 for the purpose of applying a bias force for moving all razors toward the left stop 53A and right stop 53B.

Figure 5B:
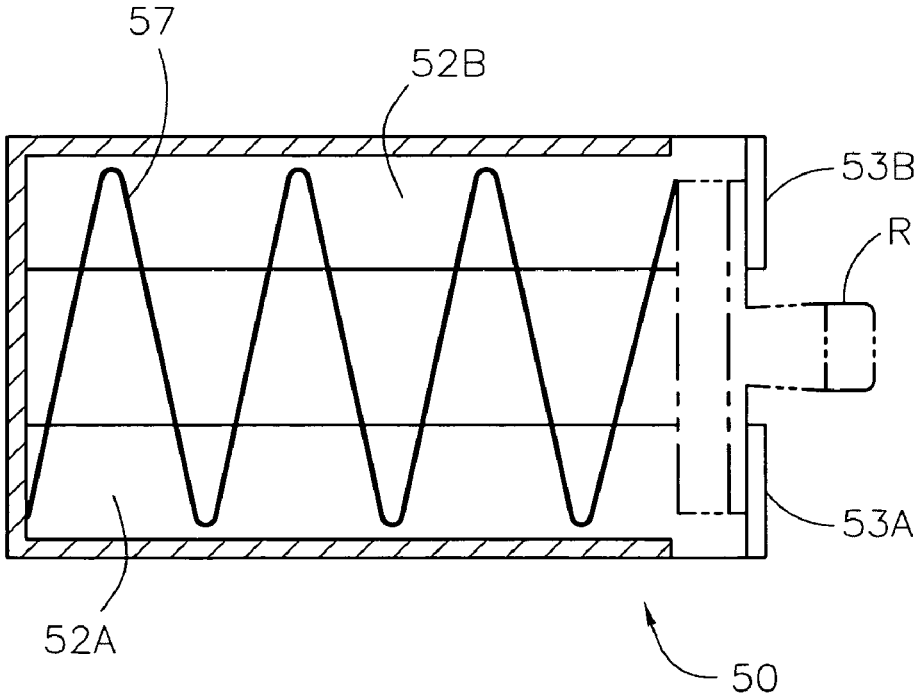
FIG. 5B is a top cross-sectional view of the razor dispenser cartridge containing one razor.

FIG. 5B shows the same razor dispenser cartridge 50 (as was shown in FIG. 5A) where some razors have been removed, and the spring 57 has expanded while yet maintaining the bias force on the remaining razor R. Thus it can be seen that there is always a razor available and convenient to the user.

The inventor envisions another version of a razor dispenser cartridge having no spring, but rather having rails sloped sufficiently to advance the razors by sliding under the influence of gravity.

Figure 6:
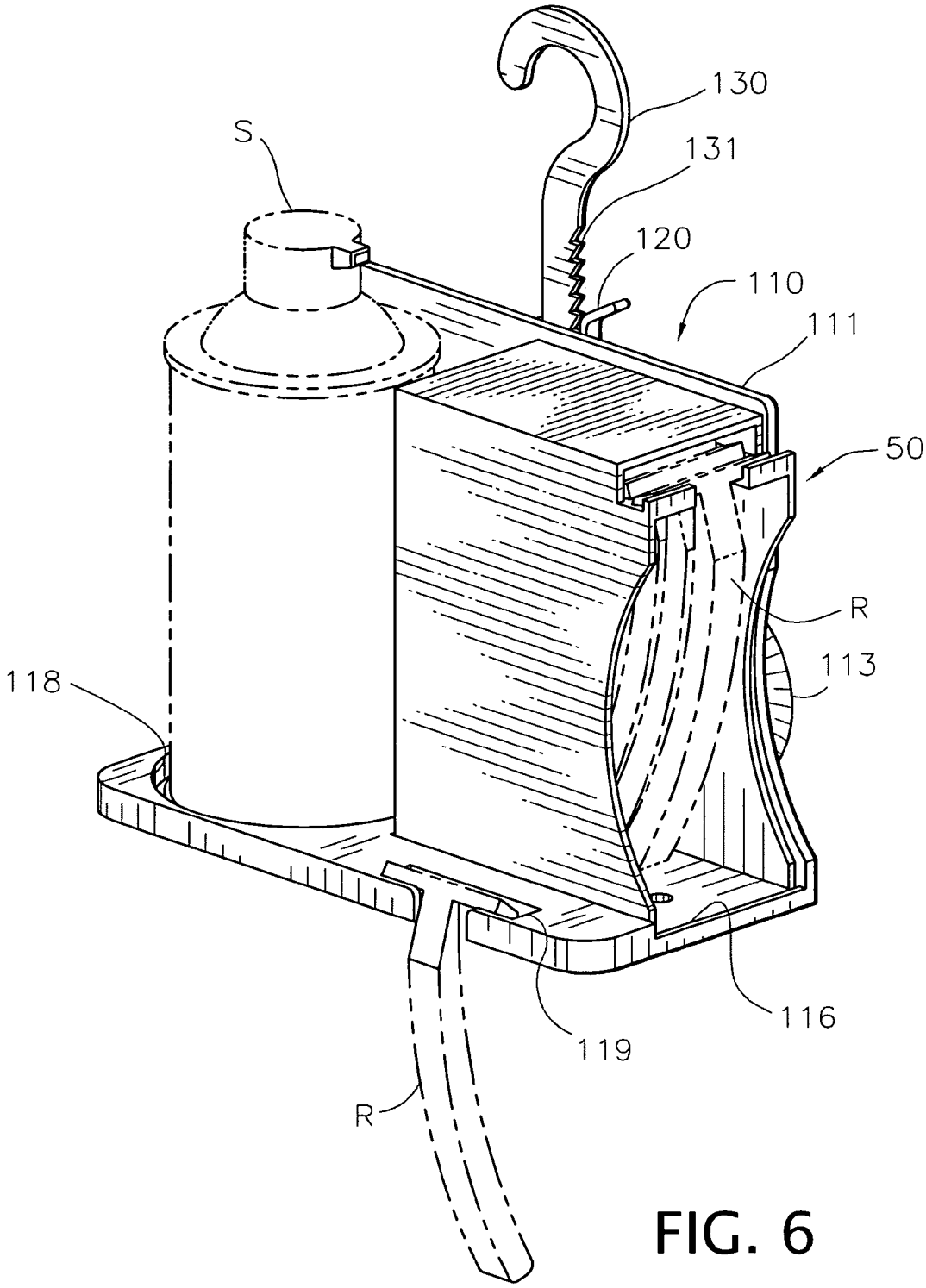
FIG. 6 is a perspective front view of another embodiment of the present invention having provisions for holding a can of shaving cream and for hanging a razor.

Another embodiment of the present invention is shown in FIG. 6. Holder 110 comprises a base 111 with a recess 116 for receiving a razor dispenser cartridge 50. The top of the holder has a hook 130 having teeth 131 for vertical adjustment. The base has a rim 118 for receiving a can of shaving cream S, and a pocket 119 for receiving a single razor R. This embodiment features greater utility by making the can of shaving cream and razor accessible and convenient.

Figure 7:
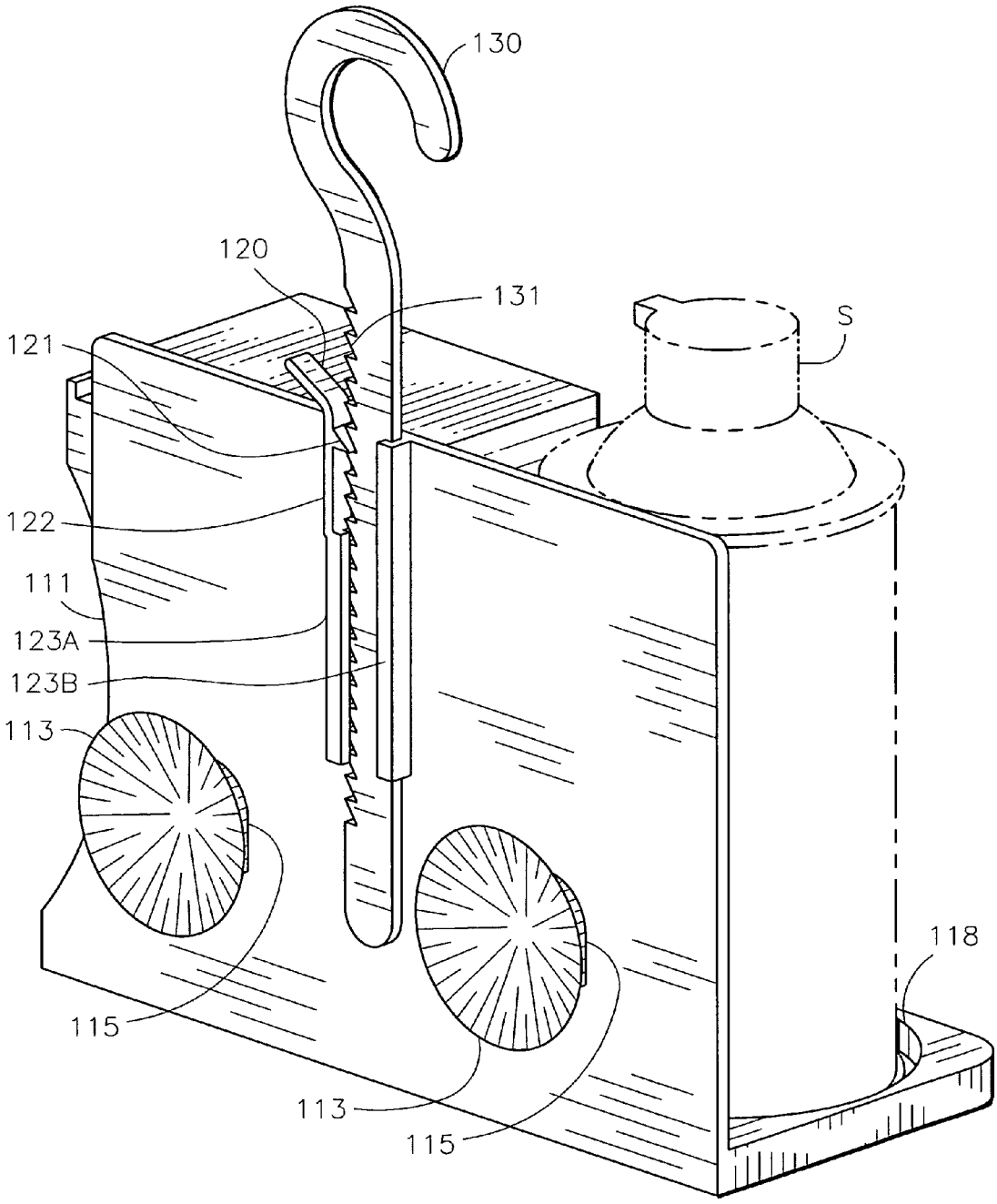
FIG. 7 is a perspective rear view of the embodiment of FIG. 6 wherein the hook is attached by an adjustable attachment means for adjusting the vertical position of the hook.

FIG. 7 shows a rear view of the embodiment of FIG. 6 more clearly showing two suction cups 113 each secured by a yoke 115. There is an adjustable hook attachment means comprising a left guide 123A and a right guide 123B for guiding the hook 130 in a vertical sliding fit. Both guides are attached to the base 111. Attached to the top of the left guide, there is a flexing member 122 which is not attached to the base, so as to provide a flexing support to a catch 121 which normally engages one of the teeth 131. Attached to the top of the catch there is a lever 120 for easy access by the user. Now it can be appreciated that by pressing down on the lever, and flexing the flexing member, the catch can be momentarily disengaged from the teeth. Thus, the hook may be momentarily repositioned vertically to a particular desired position. Then, by releasing the lever, the flexing member re-engages the catch into another of the teeth, and the desired hook position is secured. Now, having disclosed the adjustable attachment means, the inventor envisions alternate embodiments of the present invention based on every embodiment herein disclosed combined with this adjustable attachment means. While this adjustable attachment means has been shown in great detail for the sake of illustration, the inventor envisions the use of alternate adjustable attachment means, such as by detents, clamp screws, and the like.

Figure 8:
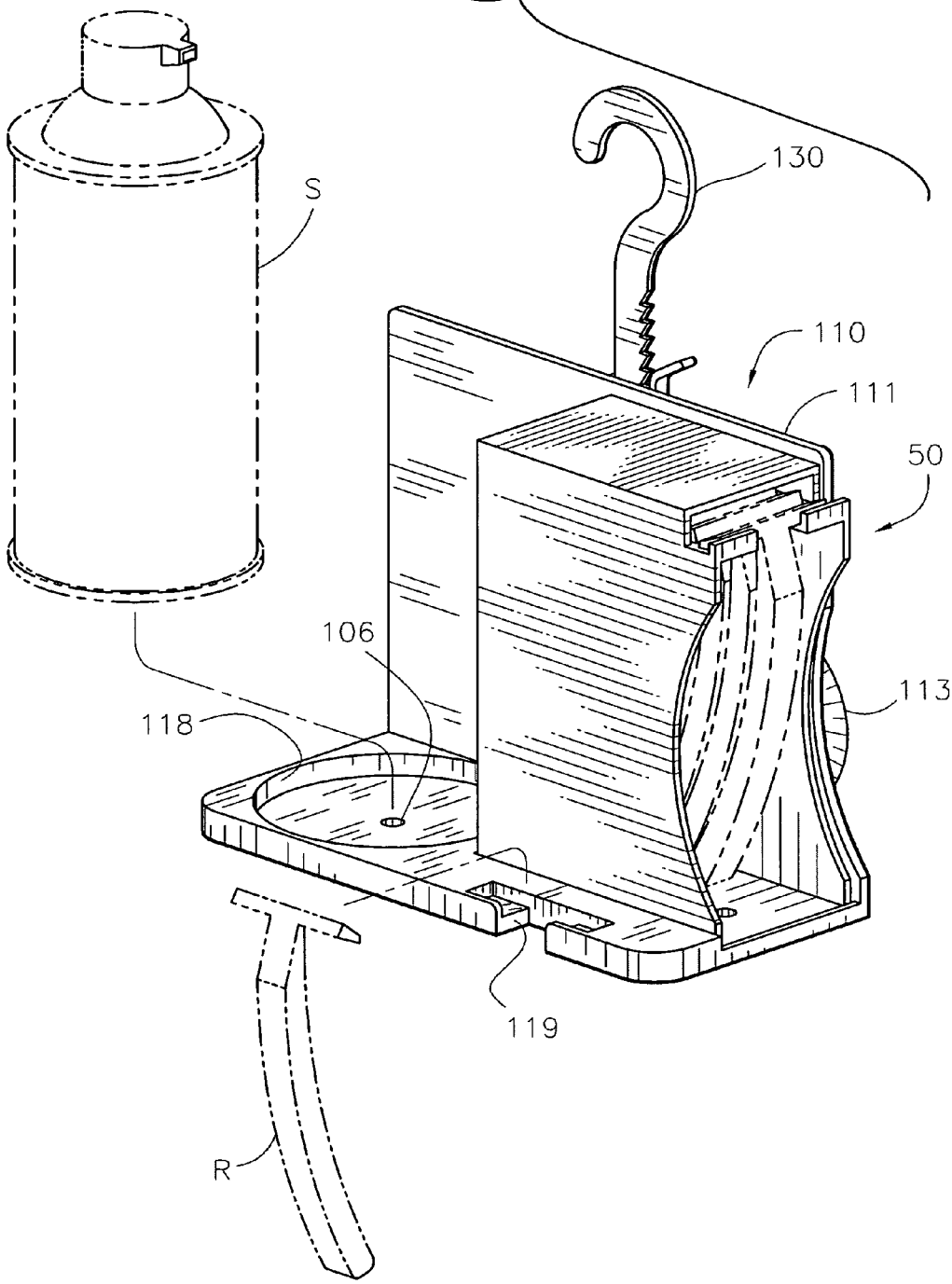
FIG. 8 is an exploded front view of the embodiment of FIG. 6 showing the fitting of the can of shaving cream and the fitting of a razor.

FIG. 8 shows how the can of shaving cream S fits into the rim 118. While the rim is shown having a circular shape, to conform with a typical cylindrical shaving cream can, the inventor also envisions the rim having other shapes such as square, or the rim could be noncontinuous; any of which would work equally well in the present invention for keeping the can of shaving cream from sliding off. There are one or more drain holes 106 in the bottom of the base 111 to prevent shower water from accumulating. FIG. 8 also shows how the razor R fits into the pocket 119. While the pocket is show having a rectangular shape, to conform with a typical razor head, the inventor also envisions the pocket having other shapes such as oval, or having two posts; any of which would work equally well in the present invention for keeping the razor from sliding off.

Figure 9:
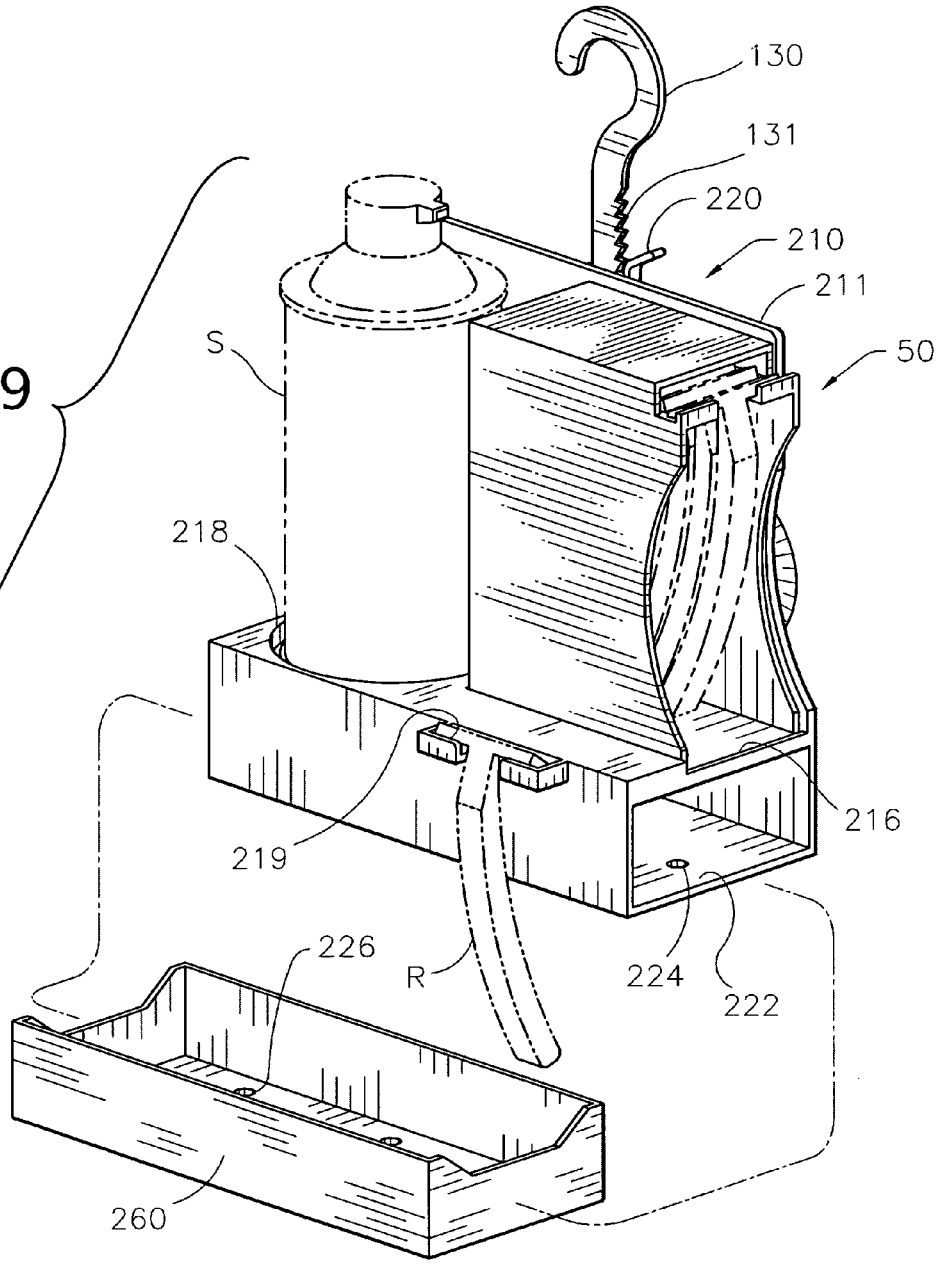
FIG. 9 is an exploded front view of another embodiment of the present invention having a shelf for receiving a drawer.

Yet another embodiment of the present invention is shown in FIG. 9 which comprises a holder 210 having a base 211 with a recess 216 for receiving the razor dispenser cartridge 50. The top of the holder has the hook 130 having teeth 131 for vertical adjustment, by momentarily pressing down on a lever 220 (as previously described) The base has a rim 118 for receiving the can of shaving cream S, and a pocket 219 for receiving the single razor R. There is a shelf 222 at the bottom of the base whose size is suited for a slidable fit with a drawer 260. The drawer is convenient and may be used for a variety of purposes, most likely to store several depleted razors until they can be disposed as a lot. The particular embodiment shown allows for the drawer to be drawn from either the left side or right side, however the inventor envisions other embodiments of the present invention in which the drawer could draw only from the left, or only from the right, or from the front. There is one or more of a drain hole 224 in the shelf for preventing an accumulation of shower water. The drawer has one or more drain holes 226 to prevent an accumulation of shower water. This embodiment features the greatest utility by making convenient the can of shaving cream and the single razor, along with repeated access to new razor from the razor dispenser cartridge as well as a convenient drawer for storing depleted razors. Now, having disclosed the drawer feature, the inventor envisions alternate embodiments of the present invention based on every embodiment herein disclosed combined with this drawer feature.

The inventor envisions yet other embodiments of the present invention which comprise unique combinations of individual features now disclosed, but not specifically illustrated. For example the inventor envisions one embodiment of the present invention based on the features illustrated in FIG. 1, but combined with the adjustable hook attachment means depicted in FIG. 7. These combinatorial embodiments of the present invention have not specifically been shown, for the sake of brevity.

While the inventor has shown in FIG. 3B an alternate securing means for securing the first embodiment to the fastener in the wall, the inventor similarly envisions the corresponding use of this securing means for every embodiment of the present invention herein disclosed.

While the inventor has shown in some detail a unique construction of a razor dispenser cartridge, the scope of the present invention encompasses the fitting of other types of razor dispenser cartridges.

While the above descriptions and embodiments contain many specific features by way of example, they should not be construed as limitations on the scope of the invention. Many other variations are possible within the scope of the following claims.

What is claimed is:

1. A holder which hangs from a shower head against a shower wall, which holder comprises:

a. a razor dispenser cartridge, b. a base having a recess for receiving the razor dispenser cartridge, c. a hook attached at the top of the base for hanging the holder on the shower head, and d. at least one suction cup attached to the base for securing the holder to the shower wall.

2. The holder according to claim 1, further comprising an adjustable attachment means for adjusting the vertical position of the hook.

3. The holder according to claim 1, further comprising:

e. a shelf attached to the base, and f. a drawer having a sliding fit with the shelf, the drawer resting on the shelf.

4. A holder for a can of shaving cream, which holder hangs from a shower head against a shower wall, which holder comprises:

a. a razor dispenser cartridge, b. a base having a recess for receiving the razor dispenser cartridge and a rim for receiving the can of shaving cream, c. a hook attached at the top of the base for hanging the holder on the shower head, and d. at least one suction cup attached to the base for securing the holder to the shower wall.

5. The holder according to claim 4, further comprising an adjustable attachment means for adjusting the vertical position of the hook.

6. The holder according to claim 4, further comprising:

e. a shelf attached to the base, and f. a drawer having a sliding fit with the shelf, the drawer resting on the shelf.

7. A holder for a can of shaving cream, and a razor, which holder hangs from a shower head against a shower wall, which holder comprises:

a. a razor dispenser cartridge, b. a base having a recess for receiving the razor dispenser cartridge, a rim for receiving the can of shaving cream, and a pocket for receiving the razor, c. a hook attached at the top of the base for hanging the holder on the shower head, and d. at least one suction cup attached to the base for securing the holder to the shower wall.

8. The holder according to claim 7, further comprising an adjustable attachment means for adjusting the vertical position of the hook.

9. The holder according to claim 7, further comprising:

e. a shelf attached to the base, and f. a drawer having a sliding fit with the shelf, the drawer resting on the shelf.

10. A holder for a razor, which holder hangs from a shower head against a shower wall, which holder comprises:

a. a razor dispenser cartridge.

b. a base having a recess for receiving the razor dispenser cartridge and a pocket for receiving the razor, c. a hook attached at the top of the base for hanging the holder on the shower head, and d. at least one suction cup attached to the base for securing the holder to the shower wall.

11. The holder according to claim 10, further comprising an adjustable attachment means for adjusting the vertical position of the hook.

12. The holder according to claim 10, further comprising:

e. a shelf attached to the base, and f. a drawer having a sliding fit with the shelf, the drawer resting on the shelf.

13. A holder for razors having handles, which holder hangs from a shower head against a shower wall, which holder comprises: a razor dispenser cartridge, a base having a recess for receiving the razor dispenser cartridge, a hook attached at the top of the base for hanging the holder on the shower head, and at least one suction cup attached to the base for securing the holder to the shower wall, wherein the razor dispenser cartridge comprises:

a. a left rail and a right rail for supporting at least one razor, wherein the rails are horizontal, parallel to one another, and spaced a distance apart for fitting the razor handles there between, b. a left stop at a near end of the left rail, and a right stop at a near end of the right rail, and c. a spring secured adjacent to a far end of the left rail and adjacent to a far end of the right rail, wherein the spring acts upon one of the razors with a force sufficient to move the razors until one razor bears against the stops.

14. A holder which hangs from a shower head against a wall having a fastener, which holder comprises:

a. a razor dispenser cartridge, b. a base having a recess for receiving the razor dispenser cartridge, c. a hook attached at the top of the base for hanging the holder on the shower head, and d. a yoke attached to the base for securing the holder to the fastener.

15. The holder according to claim 14, further comprising an adjustable attachment means for adjusting the vertical position of the hook.

16. The holder according to claim 14, further comprising:

e. a shelf attached to the base, and f. a drawer having a sliding fit with the shelf, the drawer resting on the shelf.

* * * * *